US005249780A

United States Patent [19]

Forte et al.

[11] Patent Number: 5,249,780

[45] Date of Patent: Oct. 5, 1993

[54] SLAG CONTROL SHAPE RELEASE APPARATUS FOR MOLTEN METAL VESSELS

[75] Inventors: Gary L. Forte, Plymouth; James P. McGuire, Taylor; Wayne Miller, Gibraltar, all of Mich.

[73] Assignee: AJF, Inc., Plymouth, Mich.

[21] Appl. No.: 898,014

[22] Filed: Jun. 12, 1992

[51] Int. Cl.[5] ..... B22D 41/14

[52] U.S. Cl. ..... 266/230; 266/272; 222/597; 164/337

[58] Field of Search ..... 266/230, 227, 236, 238, 266/272; 222/602, 597; 164/337, 437

[56] References Cited

U.S. PATENT DOCUMENTS

| | | | |
|---|---|---|---|
| 4,431,169 | 2/1984 | Fazii et al. | 266/236 |
| 4,553,743 | 11/1985 | LaBate, II et al. | 266/272 |
| 4,601,415 | 7/1986 | Koffron | 222/597 |
| 4,610,436 | 9/1986 | LaBate, II et al. | 266/272 |
| 4,637,592 | 1/1987 | LaBate, II et al. | 266/272 |
| 4,640,498 | 2/1987 | LaBate et al. | 266/272 |
| 4,725,045 | 2/1988 | Cutre et al. | 266/230 |
| 4,871,148 | 10/1989 | Koffron | 266/230 |
| 4,922,994 | 5/1990 | Ogura et al. | 266/230 |
| 4,968,007 | 11/1990 | Forte et al. | 266/100 |
| 5,044,610 | 9/1991 | Koffron | 266/45 |

*Primary Examiner*—Scott Kastler

*Attorney, Agent, or Firm*—Basile & Hanlon

[57] ABSTRACT

A slag control shape is releasably mounted on a cover for a molten metal vessel. An actuator is connected to a slag control shape release member to retract the release member from a first position engaged with the slag control shape to a second position separated from the slag control shape allowing the slag control shape to freely drop into the molten metal receptacle. The actuating end of the actuator is located at an easily accessible operator position for remote actuation of the release member. In one embodiment, the actuator is a flexible cable attached at one end to the release member mounted on the cover and having a second end located remote from the cover at an easily accessible operator position. In another embodiment, a pair of eccentric cams are mounted on the cover and the molten metal receptacle and pivot into engagement upon a downward force exerted on the actuator cable to retract the release member from engagement with the slag control shape.

16 Claims, 4 Drawing Sheets

SLAG CONTROL SHAPE RELEASE APPARATUS FOR MOLTEN METAL VESSELS

BACKGROUND OF THE INVENTION

1. Field of the Invention

The present invention relates, in general, to metal making apparatus and, specifically, to molten metal receptacles and, more specifically, to slag control shapes used in molten metal vessels.

2. Description of the Art

In metal making processes, such as steel making, molten metal is transferred from a furnace or converter by a ladle to a tundish or directly to a casting machine. In all metal making processes, and, in particular, in steel making processes, a layer of slag containing metal impurities forms above the top surface of the molten metal within the ladle and the tundish. When the molten metal is discharged from the ladle or tundish, it is necessary to maintain a separation between the slag and the molten metal so that high quality steel without significant amounts of slag can be produced.

The slag forms a layer of impurities several inches thick on top of the layer of molten metal in the ladle and in the tundish. In addition, the flow of molten metal through the discharge nozzle in the ladle or tundish creates a vortex which introduces a conically-shaped rotation to the molten metal immediately above the discharge nozzle. When a sufficient quantity of molten metal is maintained within the ladle or tundish, the vortex forms completely within the molten metal layer and does not reach to the slag layer atop the molten metal layer. However, when the level of molten metal within the ladle or tundish drops below the predetermined critical depth, the vortex reaches into the slag layer and draws slag through the center of the vortex to the discharge nozzle along with molten metal. This causes the introduction of slag into the molten metal as it is discharged from the ladle or the tundish and results in steel having less than desirable quantities as well as creating a potentially hazardous situation.

In order to prevent the introduction of slag into the molten metal, various slag control shapes, such as balls, frustoconical bodies, etc., as shown in U.S. Pat. Nos. 4,725,045 and 4,968,007, are introduced into the transfer ladle or tundish. Such slag control shapes or bodies have a predetermined specific gravity less than the specific gravity of the molten metal and greater than the specific gravity of the slag layer so that the slag control shape or body is buoyantly supported at the interface between the slag layer and the molten metal layer. Such slag control bodies or shapes are also designed to locate and center themselves automatically in the vortex formed above the discharge nozzle from the molten metal vessel or receptacle. The lower portion of such slag control bodies is disposed in the molten metal layer and will enter and seat within the upper portion of the discharge nozzle of the molten metal receptacle when the molten metal layer drops below a predetermined depth so as to block the discharge nozzle and prevent the discharge of slag from the receptacle.

While such slag control bodies or shapes have found widespread use and effectively block the undesirable discharge of slag from a molten metal vessel, such as a transfer ladle or tundish, the introduction of such slag control bodies into the molten metal receptacle has proved to be a problem.

Typically, such slag control bodies are introduced into the transfer ladle or tundish at a predetermined time during the discharge of molten metal from the ladle or tundish. The time of insertion of the slag control body is based on an operator's experience, based on the total time of molten metal discharge, or on a potentially inaccurate scale reading. As ladles positioned in caster turret arms are typically 20 feet or more in height, overhead cranes have been used to drop the slag control body into the ladle at the point in time indicated by an operator. However, such cranes are assigned numerous other tasks which make it difficult to insure that a crane is available at the precise time that the operator determines it necessary to insert the slag control body into the molten metal vessel.

A small number of metal making or casting machine installations have a stairway located adjacent the discharge position of a ladle which enables a worker, such as a ladleman, to climb to the top of the ladle and insert the slag control body into the ladle at the required time. However, the height of the ladle, the approximate 25 pounds or more weight of the slag control body, and the high temperatures involved in the molten metal process make such a task difficult, undesirable and dangerous. Further, the ladleman typically has other duties in monitoring the metal making process which must be neglected for the time it takes to climb the stairs and insert the slag control body. Dedicating one person solely to the task of inserting the slag control body into the molten metal vessel at the required time adds costs to the metal making process as such an individual is only required is to perform his single task at widely spaced, intermittent intervals.

Thus, it would be desirable to provide an apparatus which simplifies the task of inserting a slag control shape or body into a molten metal vessel. It would also be desirable to provide an apparatus for inserting a slag control body into a molten metal vessel which may be actuated at an easily accessible position remote from the point of insertion of the slag control body into the molten metal vessel.

SUMMARY OF THE INVENTION

The present invention is a slag control shape release apparatus for a molten metal receptacle having an open top end, side and bottom walls, an interior cavity containing a layer of slag covering a layer of molten metal, a discharge nozzle formed in the bottom wall, a cover removably closing the open top end of the receptacle and having an aperture extending therethrough, and a slag control shape insertable into the receptacle and buoyantly supported at the interface between the layer of slag and the layer of molten metal, the slag control shape release apparatus includes means, mounted on the cover, for releasably mounting the slag control shape on the cover and means, connected to the mounting means, for actuating the mounting means to release the slag control shape from the cover into the molten metal receptacle, the actuating means being operable from a location remote from the cover when the cover is mounted on the molten metal receptacle.

In one embodiment, the mounting means comprises an aperture formed in the cover through which a hanger mounted on and extending outward from the slag control shape extends. A pin is slidably mounted on the cover and is biased to a first, extended position in which the pin engages the hanger to support the slag control shape on the cover.

The actuating means, in one embodiment, comprises a flexible cable having a first end connected to the mounting means or pin. The cable has a second end located remote from the pin at an easily accessible position for retraction of the mounting means or pin from the first position to the second retracted position. The second end of the cable is located at a remote location from the cover in an easily accessible position for an operator attending to the molten metal process utilizing the molten metal receptacle.

In another embodiment, the actuating means comprises first and second eccentric cams mounted on the cover and the molten metal receptacle, respectively. A first cable is fixedly connected at one end to the first cam and to the mounting means or pin at another end. A second cable is fixedly connected to the second cam at one end and has a second end located at a position remote from the second cam. The first and second cams are disposed in close proximity when the cover is mounted on the molten metal receptacle such that movement of the second cable causes rotation of the second cam into engagement with and simultaneous rotation of the first cam to move the first cable in a direction to retract the mounting means or pin to the second, retracted position to release the pin from engagement with the slag control shape and enabling the slag control shape to drop into the interior of the molten metal receptacle.

The slag control shape release apparatus of the present invention overcomes certain problems associated with the use of such slag control shapes in molten metal receptacles, such as ladles or tundishes. The release apparatus of the present invention enables the slag control shape to be automatically dropped at the proper time, as determined by a ladleman, into the interior of the molten metal receptacle wherein the slag control shape is buoyantly supported at the slag/molten metal interface and will seat in the discharge nozzle to prevent the discharge of slag from the molten metal receptacle when the layer of molten metal reaches a critical, low level within the molten metal receptacle. The same operator or ladleman attending to the molten metal process utilizing the molten metal receptacle can thusly control the release of the slag control shape at the proper time without leaving his normal work station or neglecting his other duties.

The slag control shape release apparatus of the present invention also eliminates the need for overhead cranes to drop slag control shapes into molten metal receptacles as well as the use of an individual specifically assigned the task of inserting the slag control shape into the molten metal receptacle at the proper time.

The slag control shape release apparatus of the present invention is of simple and inexpensive construction and can be easily mounted on existing molten metal receptacle covers without extensive modification of such covers or molten metal receptacles.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

The present invention is a slag control shape or body release apparatus which inserts a slag control shape into a molten metal vessel, such as a transfer ladle or tundish, at an appropriate time determined by an operator or ladleman.

Figure 1:
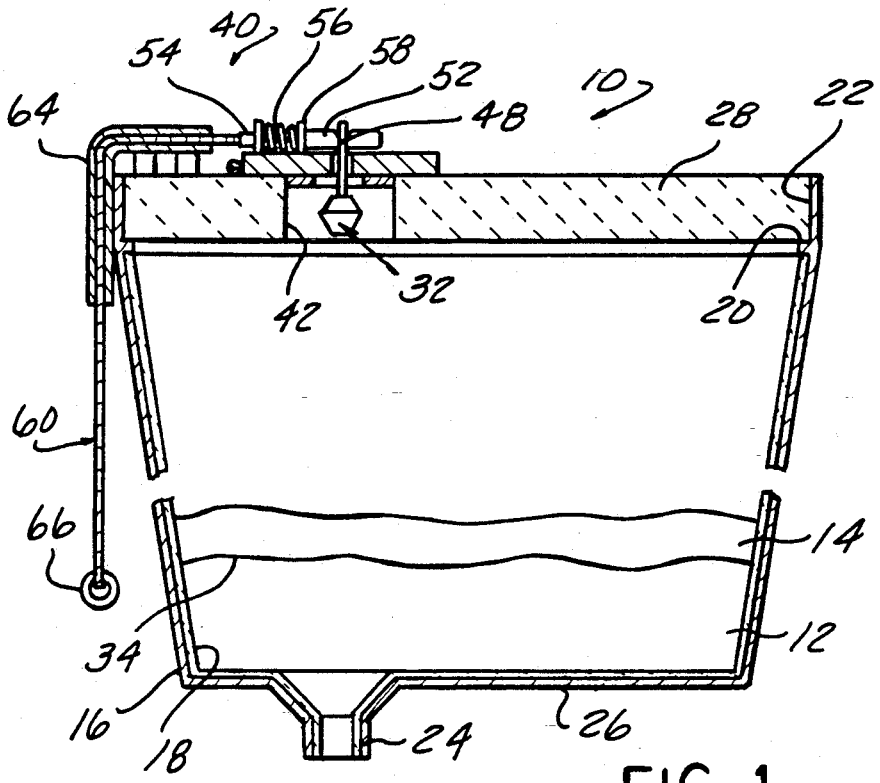
FIG. 1 is a cross-sectioned, side view of a slag control shape release apparatus of the present invention mounted on a transfer ladle.

As shown in FIG. 1, a molten metal receptacle 10 is provided for containing a layer of molten metal 12, such as steel, etc. As is conventional, a layer of slag 14 forms on the top of the layer of molten metal 12 within the vessel 10. Although the molten metal vessel 10 is illustrated as being in the form of a transfer ladle used to transfer molten metal from a tapping converter or furnace to a tundish or casting machine, it will be understood that the slag control release apparatus of the present invention may also be employed with other types of molten metal vessels, such as tundishes, etc.

By way of background, the molten metal vessel or ladle 10 includes outer, generally conical side walls formed of a metallic outer shell 16 and an inner layer 18 formed of a refractory material, such as firebrick, etc. A shoulder denoted by reference number 20 is formed adjacent an open top end 22 of the ladle 10. A discharge nozzle or outlet 24 is formed in a bottom wall 26 of the ladle 10 and provides an outlet path for molten metal from the ladle 10 to a tundish, casting machine, etc.

Figure 3:
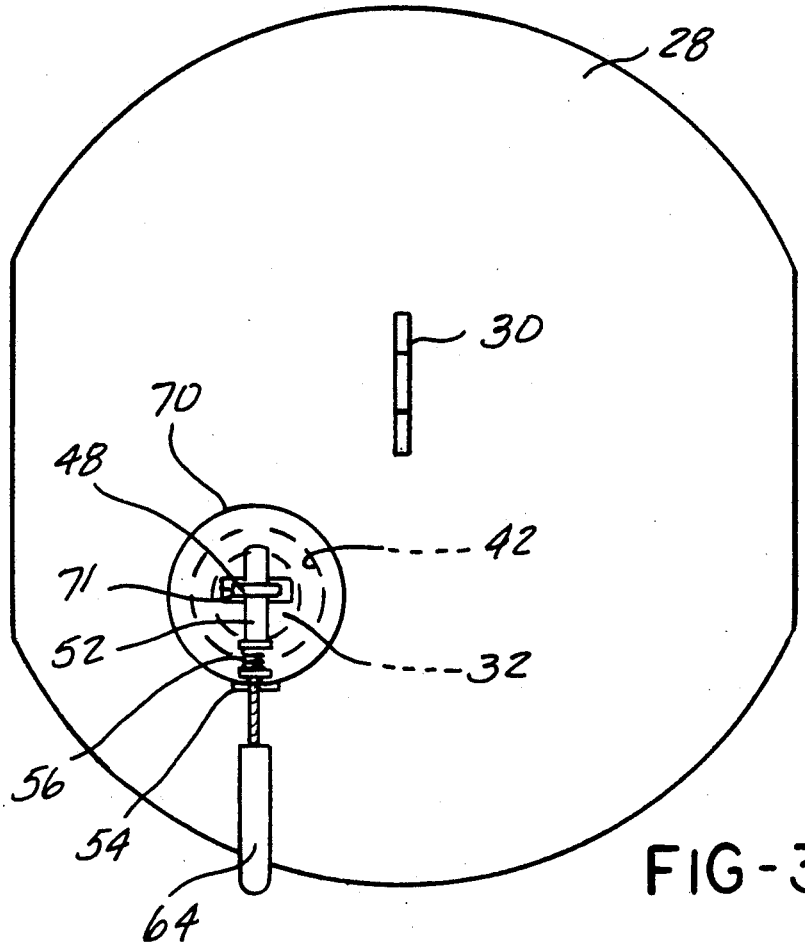
FIG. 3 is a plan view of the slag control shape release apparatus and transfer ladle cover shown in FIG. 1.

Although not required or always used, a cover 28 having a generally circular shape with two opposed straight sides, as shown in FIG. 3, is formed of a refractory material and is removably inserted into the shoulder 20 in the open top end 22 of the ladle 10 to close off the interior of the ladle 10 in order to retain heat within the molten metal 12 in the ladle 10. The cover 28 is mounted on and removed from the ladle 10 by means of a crane which engages a hook 30 mounted on the cover 10.

As is conventional, a slag control shape or body denoted generally by reference number 32, is employed to prevent the discharge of slag 14 through the discharge nozzle 24 when the layer 12 of molten metal reaches a predetermined low depth. The slag control shape or body 32 may have any predetermined size and shape, such as that disclosed in Applicant's own U.S. Pat. No. 4,968,007 or the plug shown in U.S. Pat. No. 4,725,045. The contents of U.S. Pat. No. 4,968,007, with regard to the description and use of the slag control body, is incorporated herein by reference. Generally, however, such slag control shapes or bodies 32 are formed of a suitable refractory material having a specific gravity less than the specific gravity of the molten metal 12, but higher than the specific gravity of the slag 14. In this manner, the slag control shape or body 32 buoyantly floats at the interface 34 formed between the layer of molten metal 12 and the slag layer 14. When the layer of molten metal 12 reaches a predetermined low level, the lower portion of slag control body 32 will engage the discharge nozzle 24 in the ladle 10 and thereby block the further discharge of molten metal and, more importantly, the discharge of slag 14 from the ladle 10.

According to the present invention, a slag control shape release apparatus 40 is provided for inserting the slag control shape or body 32 into the ladle 10 at the appropriate time determined by an operator monitoring the metal making process utilizing the ladle 10. The apparatus 40 includes a means for releasably mounting the slag control shape or body 32 on the cover 28 and, means, connected to the mounting means, for actuating the mounting means to release the slag control shape 32 from the cover 28, the actuating means being operable and accessible to the operator at a location remote from the cover 28. In a preferred embodiment, a bore 42 is formed in the cover 28 generally centered over the discharge nozzle 24. Suitable locating means, not shown, will also be formed on the cover 28 to insure that the cover 28 is inserted in the proper position on the ladle 10 to position the bore 42 in the cover 28 substantially over the discharge nozzle 24 of the ladle 10. An upper end 44 of the bore 42 is closed off by means of an extension of the cover 28 or by separate high temperature insulation which is attached to the cover 28. A smaller aperture 46 is formed in the extension 44 and receives a hanger 48 integrally formed with and extending outward from one end of the slag control shape 32. The hanger 48 has a central aperture 50 extending therethrough for receiving a slidable pin 52. The pin 52 is part of the slag control shape mounting means and is slidably supported on the top surface of a lid 70.

Figure 2:
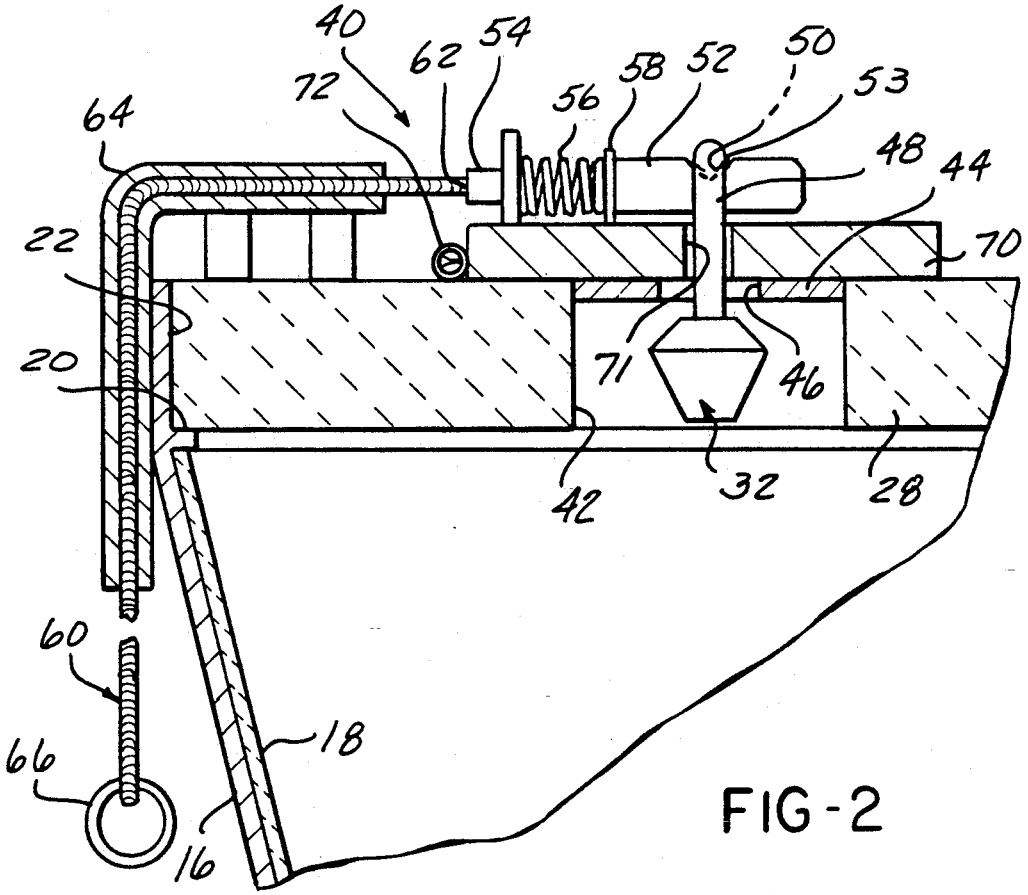
FIG. 2 is a partial, enlarged view of the slag control shape release apparatus shown in FIG. 1.

As shown in FIGS. 1–3, the lid 70 is pivotally mounted on the top surface of the cover 28 by means of a suitable hinge 72. The lid 70 covers the upper opening of the bore 42 in the cover 28 to retain heat within the ladle 10 when the cover 28 is mounted on the ladle 10. The slot 71 is formed in the lid 70 to receive the hanger 48 of the slag control shape 32 therethrough as described above.

The pin 52 includes a notch 53 which engages and supports the slag control shape hanger 48 when the pin 52 is in a first extended position shown in FIGS. 1 and 2.

The mounting means also includes a stop bracket 54 which is attached to the top surface of the lid 70 and has a bore extending therethrough. A biasing means, such as a coil spring 56, engages the stop bracket 54 at one end and one end 58 of the pin 52 at another end. The biasing means 56 normally biases the pin 52 to the first, extended position shown in FIGS. 1 and 2. However, the biasing force of the biasing spring 56 is overcome, as described hereafter, by a force exerted on an actuating means which moves the pin 52 to a second position separated from the hanger 48 on the slag control shape 32 and allows the slag control shape 32 to freely drop into the interior of the ladle 10 for normal functioning of the slag control shape 32.

Figure 4:
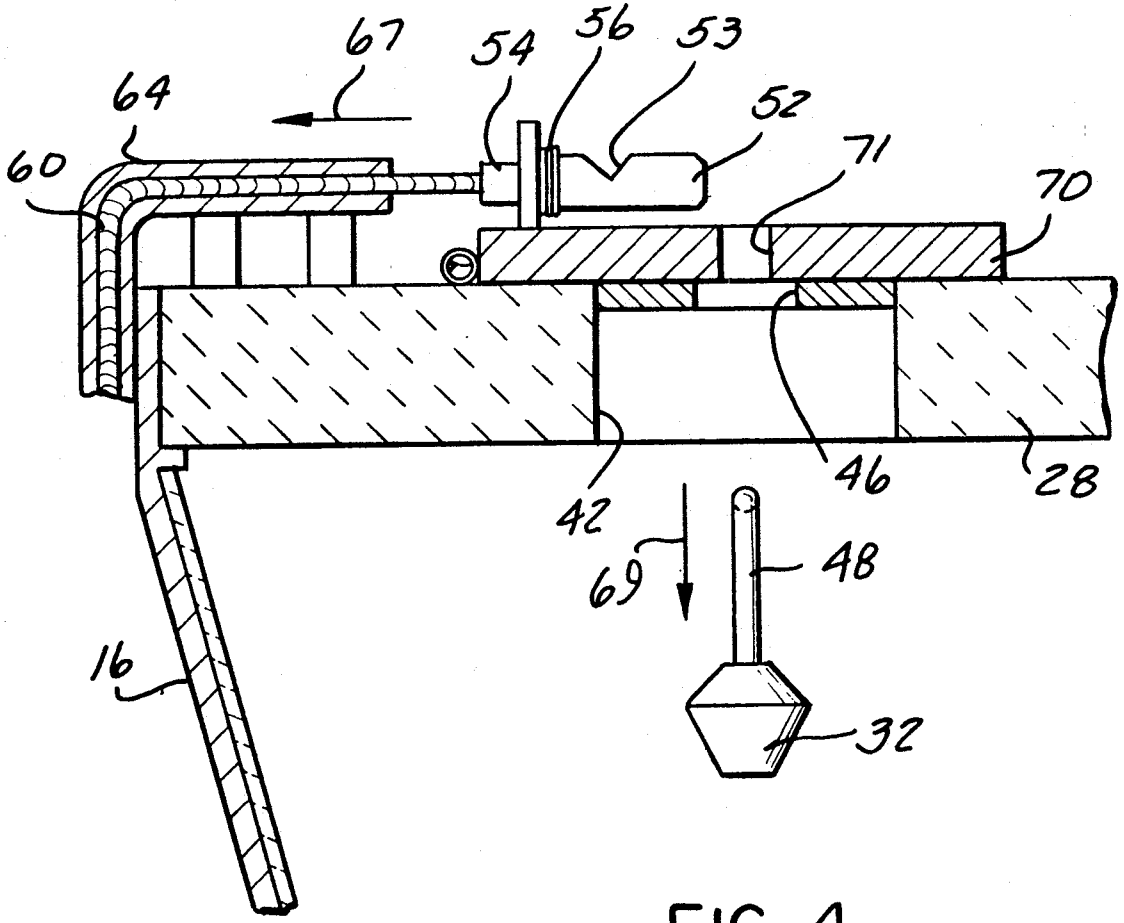
FIG. 4 is a partial, enlarging view similar to FIG. 2, but shown in the pin in its second, retracted position.

In a preferred embodiment, the actuating means comprises a flexible cable, such as a steel cable 60. A first end 62 of the cable 60 extends through the bore int he stop bracket 54 and is fixedly connected to the pin 52. The cable 60 is surrounded by the biasing spring 56 as shown in FIG. 2. Further, a cable sleeve 64 in the form of a hollow, steel conduit is attached to the upper edge of the cover 28 and extends downward below the cover 28 and an adjoining portion of the side wall 16 of the ladle 10 when the cover 28 is mounted on the top end 22 of the ladle 10 to protect a portion of the cable 60. A second end 66 of the actuating cable 60 is located at a position remote from the cover 28 when the cover 28 is mounted on the top end 22 of the ladle 10. Preferably, the second end 66 of the cable 60 is located at an easily accessible position for an operator, such as a ladleman, typically situated near the bottom of the ladle 10. The ladleman can pull downward on the second end 66 of the cable 60 to retract the pin 52 from the first position shown in FIG. 2 in the direction of the arrow 67 in FIG. 4 to the second, retracted position shown in FIG. 4 thereby pulling the pin 52 from the hanger 48 on the slag control shape 32 and allowing the slag control shape 32 to freely drop into the interior of the ladle 10, arrow 69 in FIG. 4, wherein it will buoyantly float at the slag/molten metal interface 16 in the ladle 10.

It will also be understood that the second end 66 of the cable 60 may be located at any other convenient position with respect to the ladle 10. For example, the cable 60 may be wrapped around the outer surface of the ladle 10 by means of a suitably shaped cable sleeve, similar to cable sleeve 64, to the right-hand side of the ladle 10 in the orientation shown in FIG. 1. Further, instead of using manual force to actuate the cable 60, various power drive means, such as fluid cylinders, etc., may be connected to the cable 60 for driving the second end 66 of the cable 60 in a direction to retract the pin 52 from the hanger 48 on the slag control shape 32 as described above.

Figure 5:
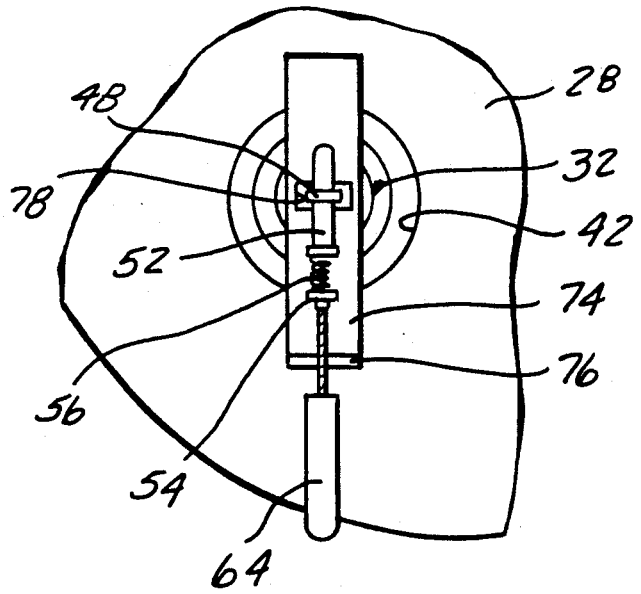
FIG. 5 is a partial, plan view showing another embodiment of the slag control shape release apparatus of the present invention.

In another embodiment shown in FIG. 5, a narrow, striplike bar 74 is mounted on the cover 28 by means of a hinge 76 and extends over the open end of the bore 42 in the cover 28. The stop bracket 54 is mounted on the bar 74 as well as the movable pin 52. A slot 78 is formed in the bar 74 for receiving the slag control shape 32 hanger 48 therethrough in the same manner as described above to enable the pin 52 to engage the hanger 48 and thereby mount the slag control shape 32 in the cover 28 prior to its release as described above by means of actuation of the cable 60. The bar 74 is pivotal away from the cover 28 to enable the slag control shape 32 to be inserted in the bore 42 in the cover 28.

In a normal sequence of operation, the cover 28 will be situated on the floor during emptying of the ladle 10 from a previous heat or load of molten metal and slag. At this time, the hinged lid 70 or bar 74 may be pivoted upward to enable the insertion of the slag control shape 32 into the bore 42 in the cover 28. The cover 70 or bar 72 is then lowered into engagement with the cover 28 with the hanger 48 of the slag control shape 32 extending outward through the slot 71 in the lid 70 or the slot 78 in the bar 74.

During this slag control body 32 mounting operation, the pin 52 is held in the second, retracted position against the force of the biasing spring 52. When the hanger 48 has been extended through the aperture 71 in the lid 70 or the aperture 76 in the bar 74, the pin 52 is released to bring the notch 54 in the pin 52 in supporting engagement with the hanger 48 to releasably mount the slag control body 32 in the bore 42 in the cover 28. The cover 28 may then be raised by means of a crane into position covering the open top end 22 of the ladle 10 after a new heat or shot of molten metal has been poured into the ladle 10.

Figure 6:
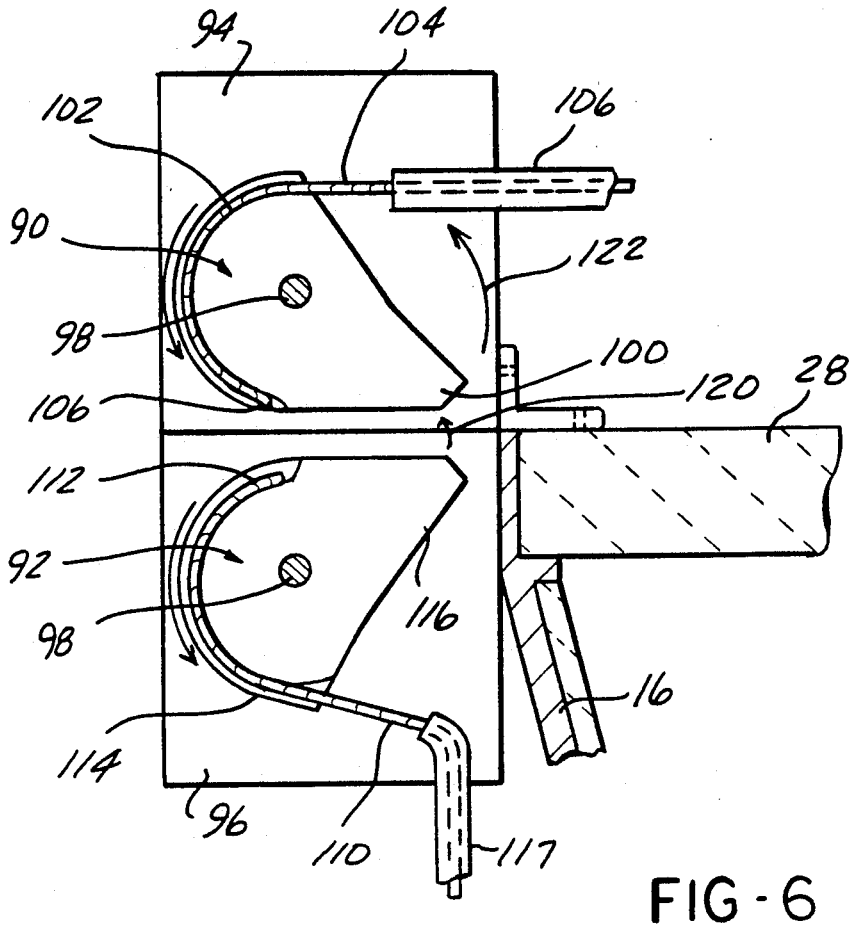
FIG. 6 is a side elevational view of another embodiment of a slag control shape release apparatus of the present invention.
Figure 7:
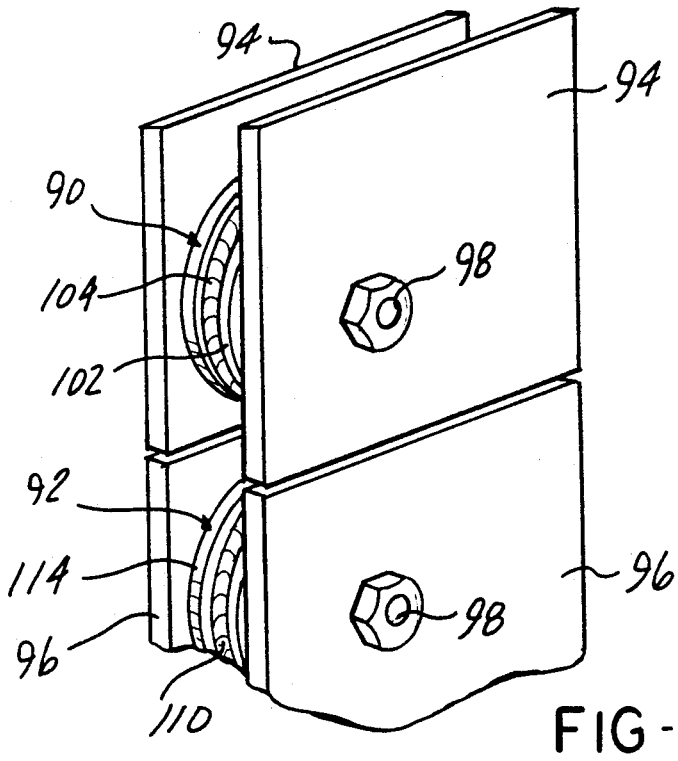
FIG. 7 is a partial, perspective view of the slag control shape release apparatus shown in FIG. 6.

Referring now to FIGS. 6 and 7, there is depicted another embodiment of a means for actuating the pin 52 to release the slag control shape 32 from the cover 28 so as to insert the slag control shape 32 into the ladle 10. In this embodiment, the pin 52, stop bracket 54, biasing spring 56 and stop plate 58 are the same as that described above and shown in FIGS. 1-3 and have not been shown in FIGS. 6 and 7.

The actuating means, in this embodiment, includes first and second eccentric cams 90 and 92, respectively. The first cam 90 is pivotally mounted between a pair of spaced plates, both denoted by reference number 94, which are fixedly attached by suitable means to one edge of the cover 28. A similar pair of plates denoted by reference number 96 are mounted to an upper edge of the side wall 16 of the ladle 10 and pivotally support the second cam 92 therebetween by means of a pivot connection 98 extending through the plates 96 and the second cam 92. A similar pivot pin 98 is used to pivotally mount the first cam 90 between the spaced plates 94.

As shown in FIGS. 6 and 7, the pairs of spaced plates 94 and 96 are disposed in substantial registry when the cover 28 is mounted on the top end 22 of the ladle 10.

The first cam 90 has an elongated leg portion 100 extending from the pivot pin 98. An opposed, generally arcuateshaped end portion 102 is also formed on the first cam 90. A first cable 104 is fixedly connected at an end 106 to the arcuate section 102 of the first cam 90 and moves with rotation of the first cam 90 as described hereafter. The first cable 104 passes through a cable sleeve 106 mounted to and extending outward from the plates 94 through the stop bracket 54, described above, to a connection with the pin 52.

Similarly, a second cable 110 is fixedly connected at one end 112 to an arcuate end portion 114 formed on the second cam 92. The opposite end of the second cam 92 is formed as an elongated leg 116 as shown in FIG. 6. The second cable 110 passes through a cable sleeve 117 mounted to the spaced plates 96 and downward to its remote second end, not shown.

The legs 100 and 116 of the first and second cams 90 and 92, respectively, are disposed in normal spaced, close proximity as shown in FIG. 6. Downward force on the second cable 110, such as a downward force exerted by the ladleman on the second end of the second cable 110 will cause the second cam 92 to pivot about the pivot pin 98 and thereby move the leg 116 in the direction of arrow 120 into engagement with the leg 100 of the first cam thereby causing rotation of the first cam 90 in the direction of arrow 122. This rotation of the first cam 90 in the direction of arrow 122 exerts a force on the first cable 104 pulling the cable 104 to the left in the orientation shown in FIG. 6. This results in a retraction of the pin 52 from the hanger 48 on the slag control body 32 thereby releasing the slag control body 32 from its mounting position in the cover 28 of the ladle 10. A discontinuance of the downward force on the second cable 110 causes the second cam 92 to return to its normal position shown in FIG. 6. The biasing force exerted by the spring 56 on the pin 52 will simultaneously cause the first cam 90 to return to its normal position shown in FIG. 6.

In summary, there has been disclosed a unique slag control shape release apparatus for use with molten metal vessels which enables a slag control shape or body to be easily inserted into the molten metal vessel at the appropriate time without requiring the use of cranes or the necessity of having the ladleman or another worker climb a stairway to manually insert the slag control shape into the vessel. The apparatus is conveniently mounted on a cover emplaced on the open top end of the vessel so as to easily position the slag control shape in the cover prior to its insertion into the vessel. The apparatus of the present invention simplifies the insertion of slag control shapes into molten metal vessels, such as ladles or tundishes, and enables the ladleman who normally monitors the metal making process utilizing the ladle or tundish to conveniently insert the slag control shape into the molten metal vessel at the appropriate time without disrupting his other duties.

What is claimed is:

1. A slag control shape release apparatus for a molten metal receptacle having an open top, side and bottom walls, an interior cavity containing a layer of slag covering a layer of molten metal, a discharge nozzle formed i the bottom wall, a cover removably closing the open top end of the receptacle, the cover having an aperture extending therethrough and a slag control shape insertable into the receptacle, the apparatus comprising:

means, mounted on the cover, for releasably mounting the slag control shape with respect to the cover; and means, connected to the mounting means, for actuating the mounting means to release the slag control shape from the mounting means and to allow the free descent of the slag control shape into the molten metal receptacle, the actuating means being operable form a location remote from the cover mounted on the molten metal receptacle.

2. The apparatus of claim 1 wherein the mounting means comprises:

a pin slidably mounted on the cover; and biasing means, coupled to the pin, for normally urging the pin to a first, extended position in which the pin engages a hanger extending from the slag control shape through the aperture in the cover for supporting the slag control shape with respect to the cover.

3. The apparatus of claim 2 wherein the actuating means comprises:

a flexible cable having a first end connected to the pin;

the cable having a second end located remote from the pin at an easily accessible position for retraction of the pin form the first position to a second, retracted position in which the pin separates from the slag control shape and allows the slag control shape to freely drop into the molten metal receptacle.

4. The apparatus of claim 2 wherein the actuating means comprises:

a first eccentric cam mounted on the cover;

a first cable fixedly connected at one end to the first cam and to the pin at another end;

a second eccentric cam mounted on the molten metal receptacle;

a second cable fixedly connected to the second cam and extending to a position remote from the second cam; and the first and second cams being disposed in close proximity when the cover is mounted on the receptacle such that movement of the second cable causes rotation of the second cam into engagement with and rotation of the first cam to move the first cable in a direction to retract the pin from the first extended position to the second retracted position to release the pin from engagement with slag control shape.

5. The apparatus of claim 2 further comprising:

a lid pivotally mounted on the cover, the lid removably closing the aperture in the cover, the pin and the biasing means being mounted on the lid;

an aperture formed in the lid for receiving the hanger of the slag control shape therethrough.

6. The apparatus of claim 1 further comprising:

a bore formed in the cover; and the mounting means releasably mounting the slag control shape in the bore in the cover when the cover is mounted on the top of the molten metal receptacle.

7. The apparatus of claim 6 wherein:

the bore in the cover is substantially aligned with the discharge nozzle in the molten metal receptacle when the cover is mounted on the top of the molten metal receptacle.

8. The apparatus of claim 1 further comprising:

a through bore formed in the cover;

a lid pivotally mounted on the cover and covering the bore when in a first position;

an aperture formed in the lid; and a hanger attached to and extending outward from the slag control shape, the hanger being insertable through the bore in the cover and the aperture in the lid and extending outward from the lid;

the mounting means engaging the hanger on the slag control shape to releasably mount the slag control shape on the cover.

9. A slag control shape release apparatus for a molten metal receptacle having an open top, side and bottom walls, an interior cavity containing a layer of slag covering a layer of molten metal, a discharge nozzle formed in the bottom wall, a cover removably closing the open top end of the receptacle, the cover having an aperture extending therethrough and a slag control shape insertable into the receptacle, the apparatus comprising:

a bore formed in and extending through the cover, the bore substantially aligned with the discharge nozzle in the molten metal receptacle when the cover is mounted on the top of the molten metal receptacle;

a pivotal member pivotally mounted on the cover and extending across at least a portion of the bore in the cover;

a pin slidably mounted on the pivotal member;

biasing means, coupled to the pin, for normally urging the pin to a first, extending position in which the pin engages a hanger extending from the slag control shape through the bore in the cover and an aperture formed in the pivotal member for supporting the slag control shape in the bore of the cover; and actuating means, connected to the pin, for moving the pin to a second, retracted position in which the pin disengages form the hanger allowing the slag control shape to freely drop for the cover into the molten metal receptacle, the actuating means being operable from a location remote from the cover mounted on the top end of the molten metal receptacle.

10. A molten metal ladle containing a layer of slag covering a layer of molten metal, the ladle having an open top end, side and bottom walls and a discharge nozzle formed in the bottom wall, the molten metal ladle comprising:

a cover for removably closing the open top end of the ladle;

an aperture formed in the cover;

a slag control shape having a specific gravity to buoyantly float at a slag layer - molten metal layer interface in the ladle;

a hanger extending from the slag control shape, the hanger insertable through and outward from the aperture in the cover;

means, mounted on the over, for releasably mounting the slag control shape with respect to the cover; and means, connected to the mounting means, for actuating the mounting means to release the slag control shape from the mounting means and to allow the free descent of the slag control shape into the ladle, the actuating means being operable from a location remote from the cover mounted on the ladle.

11. The receptacle of claim 10 wherein the mounting means comprises:

a pin slidably mounted on the cover; and biasing means, coupled to the pin, for normally urging the pin to a first, extended position in which the pin engages a hanger extending from the slag control shape through the aperture in the cover for supporting the slag control shape with respect to the cover.

12. The receptacle of claim 11 wherein the actuating means comprises:

a flexible cable having a first end connected to the pin;

the cable having a second end located remote from the pin at an easily accessible position or retraction of the pin form the first position to a second, retracted position in which type pin separates from the slag control shape and allows the slag control shape to freely drop into the ladle.

13. The apparatus of claim 11 further comprising:

a lid pivotally mounted on the cover, the lid removably closing the aperture in the cover, the pin and the biasing means being mounted on the lid;

an aperture formed in the lid for receiving the hanger of the slag control shape therethrough;

the pin and the biasing means being mounted on the lid.

14. The receptacle of claim 10 wherein:

the aperture in the cover is substantially aligned with the discharge nozzle of the ladle when the cover is mounted on the top end of the ladle.

15. The apparatus of claim 10 wherein the actuating means comprises:

a first eccentric cam mounted on the cover;

a first cable fixedly connected at one end to the first cam and to the pin at another end;

a second eccentric cam mounted on the molten metal receptacle;

a second cable fixedly connected to the second cam and extending to a position remote from the second cam; and the first and second cams being disposed in close proximity when the cover is mounted on the receptacle such that movement of the second cable causes rotation of the second cam into engagement with and rotation of the first cam to move the first cable in a direction to retract the pin from the first extended position to the second retracted position to release the pin from engagement with slag control shape.

16. The apparatus of claim 10 further comprising:

a bore formed in the cover; and the mounting means releasably mounting the slag control shape in the bore in the cover when the cover is mounted on the top end of the ladle.

* * * * *